166-307 SR

10/28/80 XR 4,230,181

United States Patent [19]

Pennington

[11] 4,230,181

[45] Oct. 28, 1980

[54] IN SITU METHOD OF PROCESSING BITUMINOUS COAL

[76] Inventor: James R. Pennington, 1127 Oak Hills Way, Salt Lake City, Utah 84108

[21] Appl. No.: 938,420

[22] Filed: Aug. 31, 1978

[51] Int. Cl.[2] ..... E21B 43/24; E21B 43/25

[52] U.S. Cl. ..... 166/259; 166/307; 299/2

[58] Field of Search ..... 166/259, 271, 304, 307, 166/308; 299/2, 4, 5

[56] References Cited

U.S. PATENT DOCUMENTS

| | | | |
|---|---|---|---|
| 1,532,826 | 4/1925 | Lessing | 299/5 |
| 2,561,639 | 7/1951 | Squires | 299/4 |
| 2,788,956 | 4/1957 | Pevere et al. | 48/DIG. 6 X |
| 3,010,707 | 11/1961 | Craighead et al. | 166/259 |
| 3,076,506 | 2/1963 | Crawford | 166/304 X |
| 3,167,121 | 1/1965 | Sharp | 166/259 |
| 3,850,477 | 11/1974 | Aldrich et al. | 166/307 X |
| 3,990,513 | 11/1976 | Perch | 299/4 X |
| 4,032,193 | 6/1977 | Drinkard et al. | 166/307 X |
| 4,076,078 | 2/1978 | Drinkard et al. | 166/271 |

*Primary Examiner*—Stephen J. Novosad
*Assistant Examiner*—George A. Suchfield
*Attorney, Agent, or Firm*—Mallinckrodt & Mallinckrodt

[57] ABSTRACT

Bituminous coal is processed in situ for the recovery of values therefrom by drilling at least one borehole into the underground deposit, introducing a solvent for inclusions of resinous and other uncarbonized vegetable matter present in the coal, which solvent may or may not also be effective in some degree to dissolve carbonaceous matter, removing the solvent pregnant with the dissolved matter, so as to leave a substantially permeable area of coal in the deposit at and adjacent to the end of the borehole, igniting the coal at the end of the borehole, and removing products of combustion from the permeablized area while introducing a combustion-supporting gas into the area for advancing a heat front through the permeablized area.

10 Claims, 3 Drawing Figures

IN SITU METHOD OF PROCESSING BITUMINOUS COAL

BACKGROUND OF THE INVENTION

Field

The invention is concerned with the recovery of various values from deposits of bituminous coal by processing the coal in situ.

State of the Art

Various in situ retorting methods have been devised for recovering gaseous and liquid products from subterranean carbonaceous deposits. Heat used in such in situ retorting is commonly produced by controlled combustion of a relatively small portion of the carbonaceous values contained in the deposit. The combustion is controlled so as to produce a heat front which moves vertically, or, in a few instances, horizontally, through the deposit.

Proper movement of the heat front is dependent upon the permeability of the underground deposit and the positioning of product recovery conduits extending into the deposit such that flow communication can be established between respective conduits.

Recovery of soluble minerals from underground deposits by solution-mining with a fluid solvent is well known. Many methods for in situ recovery of sodium minerals, nahcolite, trona, etc. using solution mining techniques have been proposed, see, for example, U.S. Pat. Nos. 2,388,009; 2,682,396; 2,822,158; 2,919,909; 2,976,690; 2,979,317; 3,050,290; 3,184,287; 3,405,974; 3,632,171; and 3,779,602. Generally, the solvent fluid is pumped down a well into contact with the underground deposit. The solvent dissolves some of the soluble mineral, and the mineral-containing solvent is pumped back to the surface. In U.S. Pat. Nos. 3,739,851; 3,759,574; and 3,779,602, methods of recovering oil from oil-shale formations containing soluble minerals in addition to shale oil or kerogen are disclosed, wherein the permeability of the formation is improved by solution mining of the soluble mineral materials prior to pyrolysis of the oil-shale.

Although it has been recognized for many years that inclusions of resinous and other uncarbonized vegetable matter occur in random fashion throughout deposits of bituminous coal, and although coal mined from such deposits has been crushed and subjected to flotation procedures for the recovery of the resinous matter in bituminous coals, containing considerable quantities of same, so far as is known no attempt has been made, nor has the possibility even been suggested, to recover such resinous matter by in situ recovery procedures and to thereby permeabilize the deposit for effective in situ processing of the coal itself.

SUMMARY OF THE INVENTION

All coals, no matter how structureless and amorphous, consist of plant debris in various stages of alteration. Bituminous coals contain uncarbonized vegetable matter, frequently at least partially in the form of resins.

Leaves of plants normally made up much of the plant debris and, during the carbonization process, produced planes of weakness, generally referred to in the industry as joint cracks or joint planes. These occur more or less in the form of networks, which in accordance with the present invention provide for the spread of a solvent by capillary action when a solvent is introduced into the coal deposit.

Other materials may be associated with coal to fill channels along planes of weakness within the coal, for example, resin samples from coals mined near Hiawatha, Utah, contain large amounts of calcium carbonate. In such instances, a solvent for such inorganic materials may be introduced in addition to a solvent for the organic matter.

In accordance with the present invention not only are resins recovered by in situ processing of a bituminous coal deposit, but by reason of dissolution of uncarbonized vegetable matter and, depending upon the solvent utilized, of some of the carbonaceous matter, such deposit is placed in condition that in situ pyrolysis for the recovery of other values from the coal can be much more effectively accomplished than heretofore. Thus, pretreatment of a bituminous coal deposit by introduction thereinto of a solvent establishes flow passages through the treated area for infiltration of heat and combustion products upon subsequent ignition of coal in the treated area, whereby pyrolysis of the coal in the area is facilitated.

THE DRAWINGS

In the accompanying drawings, which illustrate in situ processing systems conforming to what is presently contemplated as the best mode of carrying out the invention in actual practice:

FIG. 1 is a view in axial vertical section of an in situ processing installation in an outcropped horizontal coal deposit in accordance with the present invention;

FIG. 2, a view in axial horizontal section of a second in situ processing installation in accordance with the invention in which a series of boreholes extend horizontally through a bituminous coal deposit from an access entry in common; and FIG. 3, a horizontal sectional view of a third in situ processing installation in accordance with the invention in which a series of boreholes extend horizontally through a bituminous coal deposit from a vertical access shaft.

DETAILED DESCRIPTION OF THE ILLUSTRATED EMBODIMENTS

In order to recover values from deposits of bituminous coal in accordance with the process of the present invention, it is necessary that there be access to the underground level of the coal deposit for the men and equipment required to carry out development drilling. Access passages may be formed by conventional mining techniques. Occasionally, however, coal deposits have outcropped and are exposed so as to permit boreholes to be drilled from the surface directly into the deposit.

Figure 1:
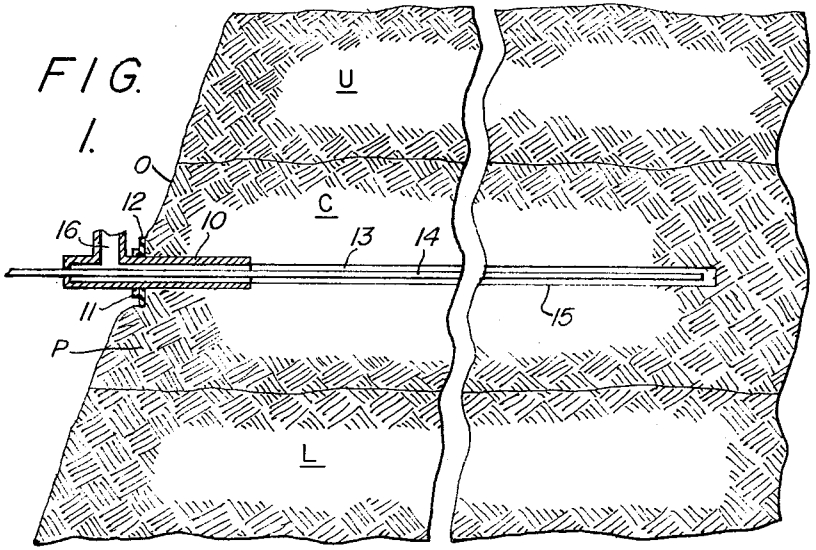

In the accompanying drawings, FIG. 1 illustrates a rather thin seam of bituminous coal C extending substantially horizontally from an outcropping O on a slope, as shown. Stratum C is sandwiched between upper and lower strata U and L, respectively, made up of other materials, e.g. shale or sandstone, which may be interbedded with or contain inclusions of carbonaceous material.

As illustrated, a borehole is drilled into the outcrop O a limited distance and is encased by standard casing 10 of suitable wall thickness (generally from one to two inches for a borehole up to nine inches in diameter). Casing 10 is normally provided with conventional packings 11 and 12 at the outcrop to seal against leakage. A second borehole 13 is then drilled from the end of casing 10, usually concentrically therewith, a predetermined distance into the coal seam C beyond the first borehole. A feedpipe 14 is then inserted through casing 10 and into and along borehole 13 to just short of the end of the latter. Feedpipe 14 is of smaller diameter than borehole 13, so as to provide an annular passage 15 therearound through which fluids may flow.

An appropriate solvent is pumped by conventional means (not shown) into and through feedpipe 14 and out the open end thereof so as to flow into borehole 13 and into and along annular passage 15 in intimate contact with the bare walls of borehole 13. The solvent preferentially and progressively dissolves the uncarbonized vegetable matter in the coal, opening up a network of capillary passages and voids more or less coinciding with the joint cracks or planes. If a proper solvent is selected, some of the carbonized matter can also be dissolved, thereby increasing the size of such passages and voids. Residual solution pregnant with dissolved matter is withdrawn through an outlet pipe 16 leading from the exposed end of casing 10. Such pregnant solution is advantageously processed in known manner for recovery of dissolved resins and other values.

In the alternative, solution flow can be reversed, being introduced through pipe 16 and withdrawn through pipe 14.

A suitable solvent may be selected by tests conducted on the particular coal concerned in any given instance. Examples of effective solvents are hexane, cyclohexane, napha, and tetralin.

If the solvent is injected with sufficient force, coal particles resulting from hydraulic action will be carried by the pregnant solution and withdrawn therewith through outlet pipe 16.

It should be noted that it may be desirable in the making of borehole 13 to use a drill core recovery method in order to determine characteristics of the coal deposit during the development stage. Also, it should be realized that deviation of borehole 13 from its initial longitudinal axis, i.e. the axis of casing 10, will generally occur due to various factors, such as drilling speed, drilling rate, varying density and hardness of the deposit, etc.

The distances to which casing 10 and feedpipe 14 will extend, respectively, may vary widely, depending on the characteristics of the coal deposit, on the nature and distribution of the soluble constituents, etc. Thus, while feedpipe 14 will always extend farther into coal deposit C than casing 10, the distance between their terminal ends may vary considerably. Generally, for coal deposits similar to that at Hiawatha, Utah, which extends horizontally for miles, casing 10 will extend from outcrop O into the coal deposit C for a distance of from about 100 to about 500 feet, usually about 300 feet, and feedpipe 14 will extend from about 2000 to about 5000 feet, depending upon thickness of the coal seam. For a coal seam having an average thickness of from about 3 to 6 feet, the feedpipe will advantageously extend for 5000 feet. For thicker seams, the distance will preferably be less.

Inside diameters of casing 10 and borehole 13 and both inside and outside diameters of feedpipe 14 may vary, depending on operational factors. The diameter of borehole 13 may be equal to or smaller than the inside diameter of casing 10 at the commencement of the operation, but will change by reason of erosion and combustion during the course of the operation, as will become apparent. Annular passage 15 will usually be adequate if from 1 to 3 inches wide, but may be varied for higher or lower flowrates. The term "annular" is intended to apply even though feedpipe 14 is resting on the bottom of borehole 13.

Feedpipe 14 may have a number of solvent discharge outlets along its length instead of merely being open at its terminal end. Also, it may be equipped with spray nozzles and/or jets to increase hydraulic action.

The selection of a particular solvent to be introduced through feedpipe 14, its temperature, and the pressure employed will depend upon circumstances. In all instances, these should be adjusted to achieve as near saturation of the solvent with dissolved matter as possible prior to its withdrawal through outlet pipe 16. It may be desirable to recycle unsaturated solution from one borehole to another to achieve saturation, in which case any solids carried by the pregnant solution should be removed by appropriate means prior to reinjection.

Erosion of supporting pillar P of coal below borehole casing 10 at the outcrop should be avoided to prevent possible collapse of the workings at that location. Thus introduction of solvent should be terminated if and when pillar P begins to erode. Sizeable erosion to the extent of cavity formation can be determined by techniques such as sonar or caliper measuring. Also, simple erosion or cavern growth toward the outcrop face may be monitored by the installation of sentinel holes drilled to varying extents in pillar P.

The second step in the method of the invention is ignition and burning of the resulting relatively porous coal deposit. This is advantageously accomplished through the workings utilized for the first step of the method. Thus, ignition of the coal is effected through the solvent discharge opening or openings in feedpipe 14 in any suitable manner. A gas such as air to support combustion within the coal deposit is pumped through feedpipe 14 at the time of and following ignition. By reason of the now relatively porous condition of the coal seam, dissimination of heat and of the combustion supporting gas is facilitated, thereby enlarging the initial combustion zone.

Hot gases and vapors representing hydrocarbonaceous values derived from the coal deposit are withdrawn through annular passage 15 and outlet pipe 16 for further processing by known procedures.

Flow rates within the system should be controlled to maintain withdrawal product temperatures above 350° F., so as to prevent condensation thereof.

As combustion progresses in the zone surrounding the open end of feedpipe 14 and the closed end of borehole 13, permeability of the formation increases and the combustion supporting gas flows increasingly to the combustion front. Concurrently, as the combustion front retreats along the feedpipe axis, high combustion temperatures will tend to burn off the feedpipe, thereby decreasing its length to coincide with the retreating combustion front.

One way of controlling combustion is to mechanically withdraw feedpipe 14 by predetermined distances after respective predetermined increments of time, so that the feedpipe retreats in advance of or along with the retreating combustion zone. Such withdrawal will tend to control the rate of combustion and thereby both lateral and longitudinal extent of the combustion zone.

To avoid combustion within supporting pillar P, temperature sensors and/or other monitoring devices may be used to locate the combustion front and to determine the geometry of the combustion area. If found desirable, additional boreholes for product recovery can be drilled either longitudinally or vertically into strategic locations in the area undergoing pyrolysis.

Figure 2:
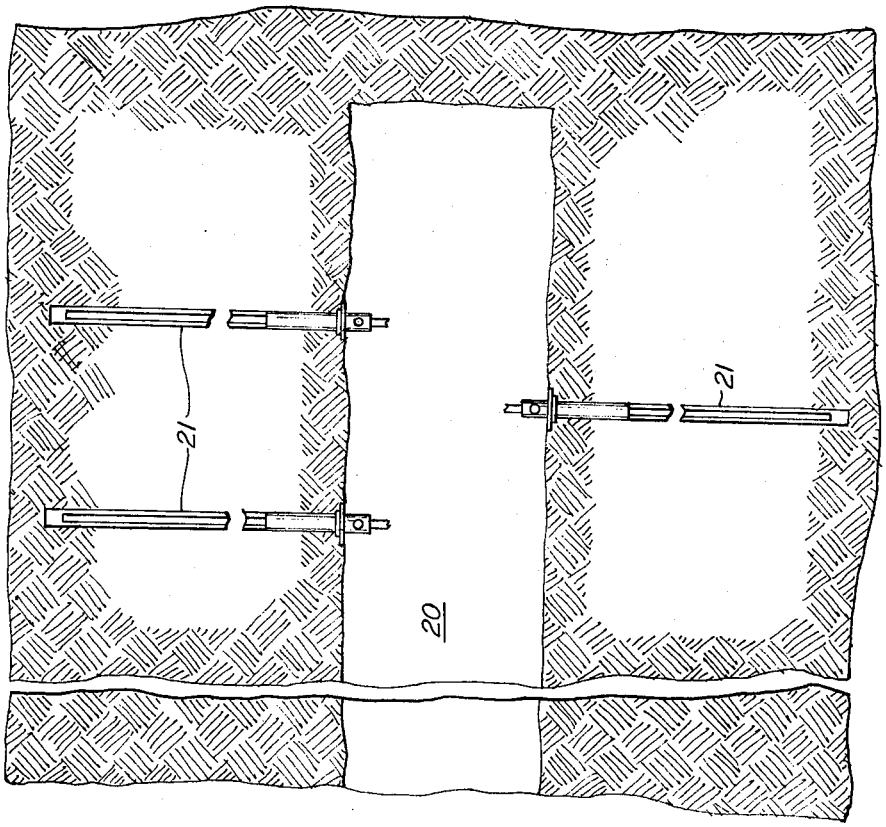

The embodiment of FIG. 2 utilizes an access entry 20 from which several boreholes 21 similar to the borehole 13 are drilled into the coal deposit. If the deposit outcrops on a slope as in FIG. 1, access entry 20 may be driven from the outcrop. If not, it is driven from a shaft (not shown) or slope.

Figure 3:
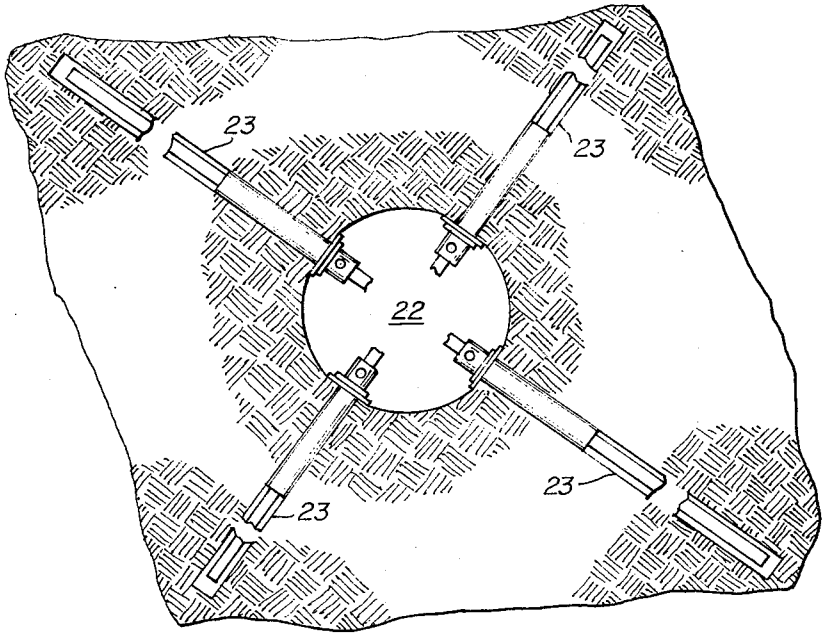

In some instances, it may be advantageous to sink a shaft 22, FIG. 3, vertically from the surface to a depth which intersects the coal seam or seams concerned, and to horizontally drill boreholes 23, with partial casing similar to those in the workings of FIGS. 1 and 2.

If dealing with an inclined coal seam, it is desirable to drill and partially case boreholes similar to that of FIG. 1 on a suitably inclined trajectory so as to stay within the coal deposit.

As with the solvent, gas flows can be reversed. The combustion air can be introduced through pipe 16 and annular passage 15 and withdrawal can be effected through pipe 14.

Various modifications of the process of the present invention may be made without departing from the spirit or scope thereof, and it is to be understood that the invention is limited only as defined in the appended claims.

I claim:

1. A method for the in situ processing of deposits of bituminous coal having inclusions of uncarbonized vegetable matter randomly distributed throughout to recover values therefrom, comprising introducing into an area of a deposit of such bituminous coal a solvent for said uncarbonized vegetable matter; removing the pregnant solvent from said area after a time period sufficient to effect dissolution of much of said uncarbonized vegetable matter, to thereby leave voids within said area and to render said area substantially permeable to combustion gases; igniting coal within said area; and supplying a combustion-supporting gas to the ignited coal while removing products of combustion, to thereby establish at least one heat front which migrates throughout said area.

2. A method in accordance with claim 1, wherein the uncarbonized vegetable matter includes resins.

3. A method in accordance with claim 1, wherein the solvent utilized is also effective to dissolve carbonized matter.

4. A method in accordance with claim 1, wherein the solvent utilized is selected from the group consisting of hexane, cyclohexane, naptha, and tetralin.

5. A method in accordance with claim 1, wherein the paths of introduction of the solvent and of removal of the pregnant solvent are reversed from time to time during application of the method to a coal deposit.

6. A method in accordance with claim 1, wherein the solvent is kept in the area of introduction in the coal deposit for a time period of sufficient length to effect substantial saturation of said solvent with dissolved matter.

7. A method in accordance with either of claims 1 or 6, wherein there are a plurality of areas within the coal deposit in which solvent is introduced, and pregnant solvent is cycled between at least some of said plurality of areas for increasing content of dissolved matter.

8. A method in accordance with claim 1, wherein at least one borehole is driven into the area, and a pipe smaller in diameter than said borehole is installed within and along the length of said borehole, the solvent being introduced through either said pipe or borehole and the pregnant solvent and products of combustion being withdrawn, respectively, through either said borehole or said pipe.

9. A method in accordance with claim 8, wherein the pipe is shortened as combustion continues therealong, either by progressive withdrawal of said pipe or by the effect of combustion heat progressing therealong.

10. A method in accordance with claim 1, wherein the solvent is introduced into the area of the deposit with sufficient force to hydraulically yield particulate matter which is suspended by the solvent and removed therewith.

* * * * *